US008494398B2

(12) United States Patent
Suzuki et al.

(10) Patent No.: US 8,494,398 B2
(45) Date of Patent: Jul. 23, 2013

(54) IMAGE FORMING APPARATUS AND POWER CONTROL METHOD THEREFOR

(71) Applicant: Canon Kabushiki Kaisha, Tokyo (JP)

(72) Inventors: Tatsuya Suzuki, Tokyo (JP); Kenji Fukushi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/668,687

(22) Filed: Nov. 5, 2012

(65) Prior Publication Data

US 2013/0058674 A1 Mar. 7, 2013

Related U.S. Application Data

(63) Continuation of application No. 12/543,894, filed on Aug. 19, 2009, now Pat. No. 8,340,545.

(30) Foreign Application Priority Data

Aug. 22, 2008 (JP) ..... 2008-214100

(51) Int. Cl.
*G03G 15/00* (2006.01)

(52) U.S. Cl.
USPC ..... 399/88; 399/37

(58) Field of Classification Search
USPC ..... 399/88, 37
See application file for complete search history.

(56) References Cited

U.S. PATENT DOCUMENTS 6,181,905 B1 1/2001 Ohta et al.
7,203,432 B2 * 4/2007 Morioka et al. ..... 399/37
7,428,391 B2 * 9/2008 Kobayashi ..... 399/88

FOREIGN PATENT DOCUMENTS

JP 2006-293212 A 10/2006
JP 2007-025010 A 2/2007
JP 2007-102008 A 4/2007

OTHER PUBLICATIONS

Machine translation of reference Miyoshi (JP 2006-293,212 A). Pub date Oct. 26, 2006.*
Japanese Office Action for JP 2008-214100. Mail date Oct. 16, 2012. (Cited in parent U.S. Appl. No. 12/543,894).

* cited by examiner

*Primary Examiner* — Walter L Lindsay, Jr.
*Assistant Examiner* — Rodney Bonnette
(74) *Attorney, Agent, or Firm* — Rossi, Kimms & McDowell LLP

(57) ABSTRACT

An image forming capable of operating with reliability and shortening the down time. An operation unit forms an image. A power source unit supplies electric power supplied from an external power source to the operation unit. A storing unit stores successful data which shows that the image forming apparatus has started successfully. A mode selection unit selects a first mode in which regular electric power is supplied to the operation unit at a start-up when the storing unit stores the successful data, and a second mode in which electric power smaller than the regular electric power is supplied to the operation unit at the start-up when the storing unit does not store the successful data. A power control unit controls the electric power supplied from the power source unit to the operation unit according to the mode selected by the mode selection unit.

9 Claims, 8 Drawing Sheets

IMAGE FORMING APPARATUS AND POWER CONTROL METHOD THEREFOR

BACKGROUND OF THE INVENTION

1. Field of the Invention

The present invention relates to an image forming apparatus that forms an image, and a power control method therefor.

2. Description of the Related Art

A previously known image forming apparatus using electro photographic technology is provided with a reading unit that reads an image of an original, a transfer unit that transfers the image of the read original onto a sheet such as a recording paper or a transfer material that is a recording medium, a fixing unit that fixes the transferred toner image to the sheet, a carrying unit that carries the sheet from the transfer unit to a delivery tray via the fixing unit, and a control unit that controls the respective units, etc. The fixing unit has a fixing roller, which is also called a heating roller, to heat and melt toner on a sheet, and a pressure roller that contacts with the fixing roller while giving pressure thereto to pinch the sheet, for example. The fixing roller is formed in a hollow shape and a heating element is held by a holding member on the center axis of the fixing roller.

The heat emitted by the heating element in the fixing roller is uniformly radiated on an inner wall of the fixing roller, and thus a temperature distribution of an outer wall of the fixing roller becomes uniform in a circumferential direction. The outer wall of the fixing roller is heated so that the temperature thereof becomes a fixing temperature (for example, 150 to 200 degrees centigrade) suitable for fixing.

The fixing roller and the pressure roller rotate in opposite directions mutually with contacting while giving pressure to each other, and pinch the sheet to which the toner has been adhered. In a pressure contact position (also referred to as a "nip position", hereinafter) between the fixing roller and the pressure roller, the toner on a sheet melts with the heat from the fixing roller, and is fixed to the sheet by the pressure given from both the rollers.

Various measures have been proposed as this heating element. For example, U.S. Pat. No. 6,181,905 discloses a fixing unit that adopts an induction heating method (IH method), in which a time required to reach the fixing temperature (a warm-up time) is short and an electricity-to-heat conversion performance is high, using high frequency induction from view points of a user's convenience and of energy saving.

Since the fixing unit of this IH method converts power supplied from AC power source into a high frequency pulse and applies it to a coil, it can control power consumption by changing a pulse width. A time between starting the image forming apparatus and enabling the image formation depends on the warm-up time required to heat the fixing roller to the fixing temperature. Other units become available in relatively short time after the start-up. Therefore, at the start-up of the image forming apparatus, if the power supplied by the AC power is concentrated on the fixing unit as much as possible, the warm-up time can be shortened. On the other hand, at the time of operation of the image forming apparatus, such as a time of image formation, the electric power is consumed by a carrying motor of the carrying unit and a high voltage power source for transferring the toner to a photoconductive medium, the recording medium in the transfer unit, or the like. Accordingly, although the electric power supplied to the fixing unit becomes lower than that at the time of a start-up, the electric power to keep the fixing temperature has to be supplied at the minimum.

Here, the limitation of the maximum electric power consumption of the image forming apparatus is determined by a specification of commercial power source to which the apparatus is connected. For example, the specification of the output port (referred to "a plug socket", hereinafter) of the 100V commercial power source used in a general office in Japan is 1500 W.

However, when an impedance of a cable wired from a switchboard to a plug socket is large, a passage of a current causes a corresponding voltage drop. Therefore, since a passage of a large current enlarges the voltage drop, there is a possibility that an abnormality occurs in an operation of the image forming apparatus.

Japanese laid-open patent publication (Kokai) No. 2006-293212 (JP2006-293212A) discloses a method for changing an operation mode to a low current mode when the voltage drop of the plug socket is detected. Japanese laid-open patent publication (Kokai) No. 2007-102008 (JP2007-102008A) discloses a method for controlling the power consumption so that the voltage drop falls within a predetermined range when the voltage drop of the power source is detected during operation.

However, the above-mentioned conventional image forming apparatuses have the following problems. A condition of the power source varies depending on an installed location and an operation environment of the image forming apparatus. For example, an impedance of the power source may be high as a result of using a thin cable or by another factor, or the image forming apparatus may share the power source with other machines by branching from the same plug socket.

If large electric power is supplied to the fixing unit in a possible early stage after powering-on in order to shorten a warm-up time of the image forming apparatus, the voltage drop at the time of a start-up may suddenly shut down the power source of the image forming apparatus at a location where the power source condition is poor.

If the method of Japanese laid-open patent publication (Kokai) No. 2006-293212 (JP2006-29312A) or Japanese laid-open patent publication (Kokai) No. 2007-102008 (JP2007-102008A) mentioned above is used, it is possible to change the control method so as to continue the operation, when power source voltage descends during the operation of the apparatus. However, when the power source of the apparatus shuts down at the time of a start-up, the control method cannot be changed by the techniques of the above-mentioned publications. Therefore, when trying to start the apparatus without improving the power source condition, since the power source of the apparatus shuts down every time the apparatus starts up, the apparatus cannot be started. Accordingly, a down time during which the apparatus cannot be used becomes long and thus a user feels distrust and a disadvantage.

As a result of this, it is necessary to give priority to the start-up of the apparatus as possible by changing a starting method so as to shorten the down time, even when the power source condition is bad.

SUMMARY OF THE INVENTION

The present invention provides an image forming apparatus and a power control method therefor that are capable of operating with reliability and shortening the down time.

Accordingly, a first aspect of the present invention provides an image forming apparatus provided with an operation unit for forming an image, comprising a power source unit adapted to supply electric power supplied from an external power source to the operation unit, a storing unit adapted to store successful data which shows that the image forming apparatus has started successfully, a mode selection unit adapted to select a first mode in which regular electric power is supplied to the operation unit at a start-up when the storing unit stores the successful data, and a second mode in which electric power smaller than the regular electric power is supplied to the operation unit at the start-up when the storing unit does not store the successful data, and a power control unit adapted to control the electric power supplied from the power source unit to the operation unit according to the mode selected by the mode selection unit.

Accordingly, a second aspect of the present invention provides a power control method of an image forming apparatus that supplies electric power to an operation unit for forming an image, the method comprising a storing step of storing successful data which shows that the image forming apparatus has started successfully, a mode selection step of selecting a first mode in which regular electric power is supplied to the operation unit at a start-up when the storing unit stores the successful data, and a second mode in which electric power smaller than the regular electric power is supplied to the operation unit at the start-up when the storing unit does not stores the successful data, and a power control step of controlling electric power supplied to the operation unit according to the mode selected in the mode selection step when electric power supplied from an external power source is supplied to the operation unit.

Accordingly, a third aspect of the present invention provides an image forming apparatus provided with an operation unit for forming an image, comprising a power source unit adapted to supply electric power supplied from an external power source to the operation unit, a storing unit adapted to store successful data which shows that the image forming apparatus has started successfully, and a power control unit adapted to supply electric power to the operation unit in a first mode at a start-up of the image forming apparatus when the storing unit stores the successful data, and to supply electric power to the operation unit in a second mode at the start-up when the storing unit does not stores the successful data, wherein a time period required that electric power supplied to the operation unit reaches regular electric power in the second mode is longer than that in the first mode.

According to the present invention, since electric power that is lower than regular electric power is applied at the beginning of a start-up when the apparatus did not start successfully at the previous start-up, the possibility that a power source suddenly shuts down can be decreased, which enables to operate with reliability and to shorten the down time. Further, cause pursuit at the time of a halt becomes easy.

The features and advantages of the invention will become more apparent from the following detailed description taken in conjunction with the accompanying drawings.

DESCRIPTION OF THE PREFERRED EMBODIMENTS

Figure 1:
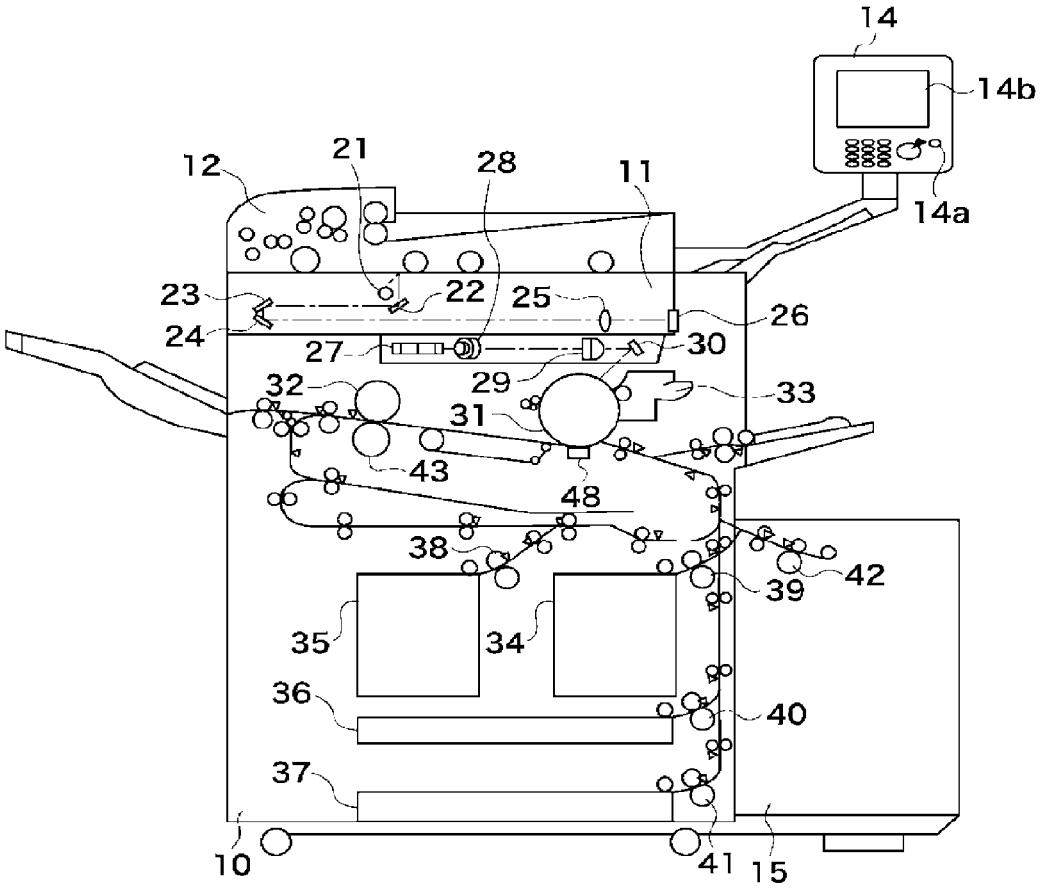
FIG. 1 is a view showing a configuration of an image forming apparatus according to an embodiment of the present invention.

Hereafter, an embodiment of an image forming apparatus and a power control method therefor according to the present invention will be described in detail with reference to the attached drawings. FIG. 1 is a view showing a configuration of the image forming apparatus according to the embodiment of the present invention. The image forming apparatus mainly comprises an image output unit 10 (a printer unit) that outputs an original image onto a recording sheet, and an image input unit 11 (a scanner unit) that reads data of an original image. Moreover, an automatic document feeder 12 is mounted on the top of the image input unit 11.

This image forming apparatus can be operated when a user sets up copy mode etc. via an operation unit 14. Various setting values and a present job condition of the image forming apparatus can be displayed on a display unit 14*b* of the operation warning for a serviceman call is displayed when a trouble arises in the image forming apparatus, and a position of a recording sheet stagnated in the apparatus is displayed when a paper jam occurs.

The image output unit 10 has sheet feed trays 34, 35, 36, and 37 on which recording sheets are stacked. A user distributes recording sheets to these sheet feed trays 34, 35, 36, and 37 freely according to a paper size. A large-capacity paper deck 15 can be connected the image output unit 10 at the exterior thereof. A recording sheet is conveyed by feed conveying rollers 38, 39, 40, 41, and 42 driven by a motor (not shown) toward a below-mentioned image formation unit.

In the image input unit 11, an original placed on an original platen glass at a top face of the unit is irradiated by a light emitted from a light source 21 that moves in the lateral direction in FIG. 1. The irradiation light is reflected by the original and its optical image is formed on a CCD 26 via mirrors 22, 23, and 24 and a lens 25. The CCD 26 converts the optical image formed thereon into an electric signal that becomes digital image data. An image conversion processing such as enlargement or reduction is applied to the image data according to a demand of a user, and then, the image to which the image conversion processing has been applied is stored into an image memory (not shown).

At the time of outputting an image, the image output unit 10 reads the image data stored in the image memory, and reconverts from the digital signal to an analog signal. The image output unit 10 irradiates a laser beam, which is modulated by an optical irradiation unit 27 according to the analog signal, onto a photoconductive drum 31 via a scanner 28, a lens 29, and a mirror 30, so that a beam spot scans on the photoconductive drum 31.

The photoconductive drum 31 has a photoconduction layer that is made of organic photo conductor of its surface, and is driven to rotate at a fixed rotational velocity during an image output job. Toner (not shown) is adhered to the photoconductive drum 31 from a development unit 33 that is filled by the toner so as to form a visible image on its surface.

On the other hand, a recording sheet is carried through a paper carrying path from one of the sheet feed trays 34, 35, 36, and 37, and passes under the photoconductive drum 31 so as to be coincident with the visible image. The visible image on the photoconductive drum 31 is transferred to the recording sheet by a transferring charging unit 48. The recording sheet that carries an unfixed visible image (the unfixed toner image) is guided to a position between a fixing roller 32 and a pressure roller 43. The unfixed toner image is melted and fixed on the recording sheet by the fixing roller 32 and the pressure roller 43, and the recording sheet is ejected outside the image output unit 10.

It should be noted that the image input unit 11 configures a reading unit that reads an image of an original; the feed conveying rollers 38, 39, 40, 41, and 42 of the image output unit 10 configure a carrying unit that conveys the recording sheet; the optical irradiation unit 27, the scanner 28, the lens 29, the mirror 30, the photoconductive drum 31, the development unit 33, and the transferring charging unit 48 configure a transferring unit (equivalent to an image formation unit) that transfers an image onto the recording sheet; and the fixing roller 32 and the pressure roller 43 configure a fixing unit that fixes the transferred toner image to the sheet, respectively. Each unit is an operation unit that operates with the power supplied from the power source unit (not shown). In this embodiment, the fixing unit is a specific operation unit that is a target of a power control.

Figure 2:
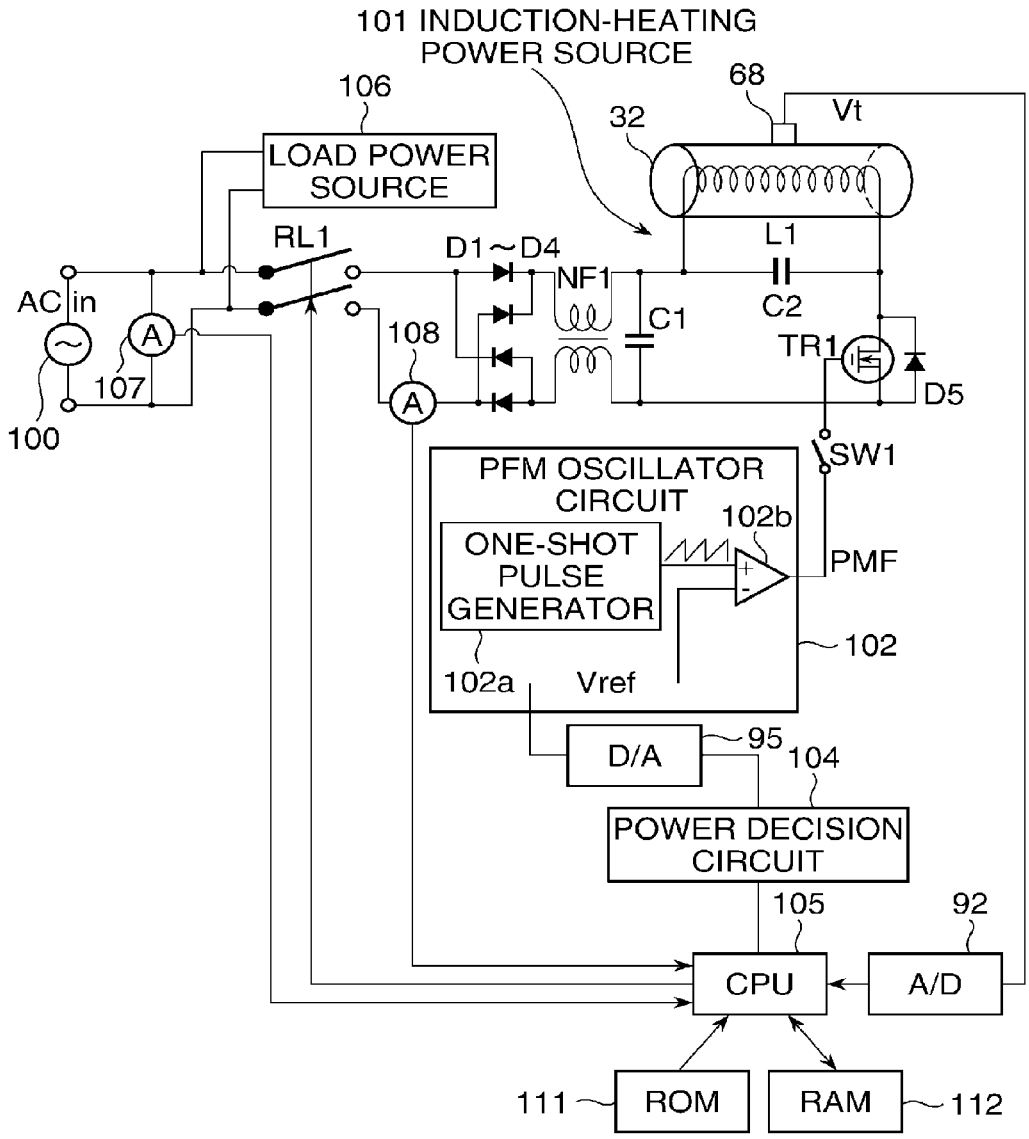
FIG. 2 is a view showing a driving power source circuit of a fixing unit of an IH method that heats a fixing roller included in the image forming apparatus shown in FIG. 1.

FIG. 2 is a view showing a configuration of a driving power source circuit of the fixing unit of the IH method that heats the fixing roller 32. Alternating current (AC) from a commercial power source 100 roughly branches into two channels in the image forming apparatus. One is an induction-heating power source 101 that is a control power source of the induction heating unit for heating the fixing roller 32 of the fixing unit, and the other is a load power source 106 that supplies power to the carrying unit, the transfer unit, etc.

The induction-heating power source 101 mainly consists of a power-switching element TR1 that is configured by a MOS-FET, an induction-heating coil L1 that is a power load of the circuit, and a flywheel diode D5 that regenerates the power accumulated in the induction-heating coil L1.

Rectifier elements D1 through D4, which are diodes for rectifying input power of alternating current, are included in the induction-heating power source 101 in the present embodiment. The transformer NF1 and a capacitor C1 constitute a noise filter whose constant is set so as to secure sufficient magnitude of attenuation to the switching frequency of the power-switching element TR1 and to allow the current to pass without attenuation in the power source frequency.

When the alternating current input voltage AC_IN is applied from the commercial power source 100, the alternating current input voltage passing through a relay switch RL1 is rectified by the rectifier elements D1 through D4, and is converted into a pulsating flow. The voltage is applied to the both terminals of the capacitor C1 through the transformer NF1. At this time, the voltage between both terminals of the capacitor C1 becomes a waveform formed by rectifying the alternating current input voltage.

A thermistor 68 is arranged at a position where the surface temperature of the fixing roller 32 can be detected. The output Vt corresponding to the detected temperature is inputted into a CPU 105 via an analog-to-digital conversion circuit (A/D) 92.

Two kinds of detection signals are inputted into the CPU 105. One is a detection signal of an AC voltage detection circuit 107 that detects a voltage (a voltage value) of the AC power source inputted into the induction-heating power source 101, and the other is a detection signal of an IH current detection circuit 108 that detects a current consumed via the induction-heating power source 101. The AC voltage detection circuit 107 is an example of a voltage value detection unit.

At the time of the regular start-up, the CPU 105 can output an output signal to a power decision circuit 104 so as to start by predetermined power without reference to the temperature detection signal of the thermistor 68 and the signals of the AC voltage detection circuit 107 and the IH current detection circuit 108. The CPU 105 controls the power decision circuit 104 to keep temperature constant by adjusting the power, when the detection temperature of the thermistor 68 reaches a target temperature. That is, the CPU 105 compares the present surface temperature of the fixing roller calculated from the output Vt of the thermistor 68 with a setting value of the heating target temperature, finds a new supplied power value P so that the difference therebetween becomes small, and outputs the signal based on the difference to the power decision circuit 104.

The CPU 105 is connected to a ROM 111 and a RAM 112, and stores backup data into these memories, or stores temporarily values of calculations performed inside the CPU 105. It should be noted that a nonvolatile memory that can hold data even in the power OFF time is used for the RAM 112.

The power decision circuit 104 controls a digital analog (D/A) conversion circuit 95 so that the D/A conversion circuit 95 outputs a control signal (a reference voltage) Vref corresponding to the power value P. The control signal Vref is inputted into a pulse frequency modulation (PFM) oscillator circuit 102. The PFM oscillator circuit (a resonance control circuit) 102 has a one-shot pulse generator 102*a* and a comparator 102*b*, and generates a PFM signal corresponding to the control signal Vref. Via a switch SW1, the PFM signal is applied to a point between a gate and a source of the power-switching element TR1 to drive the switching of the power-switching element TR1. Accordingly, a drain current ID flows and the induction-heating coil L1 is energized.

When a temperature control signal (the PFM signal) is inputted into the induction-heating power source 101 for the induction-heating coil L1, a high-frequency alternating current power with a frequency from about 20 kHz to 100 kHz occurs in the output terminals of the induction-heating power source 101. According to this operation, the induction-heating coil L1 generates an alternating current magnetic field. The alternating current magnetic field generated in the induction-heating coil L1 makes the high frequency magnetic flux pass through the fixing roller 32 through a ferrite core, and generates an eddy current in the fixing roller 32. Then, the fixing roller 32 heats itself because the Joule's heat occurs inside the fixing roller 32.

The value of the control signal Vref outputted from the power decision circuit 104 determines a duty of the PFM signal generated by the PFM oscillator circuit 102, and the time to flow a current to the induction-heating coil L1. The CPU 105 can calculate the calorific value of the fixing roller 32 and the power consumption based on these numeric values stored in the RAM 112. In the case of the fixing unit, the power consumed by the above-mentioned heating operation is usually from about 200 W to several kilowatts.

Figure 3:
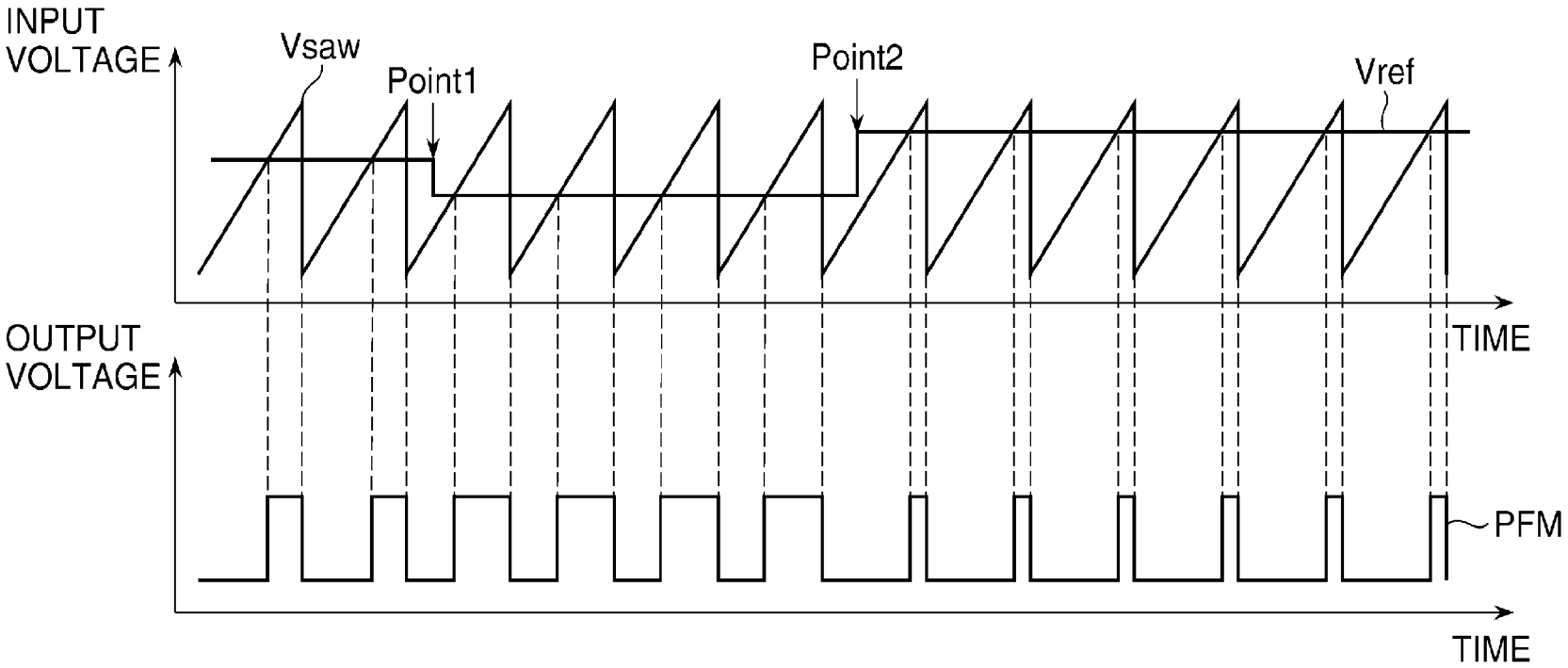
FIG. 3 is a timing chart showing operations of a resonance control circuit included in the driving power source circuit shown in FIG. 2.

FIG. 3 is a timing chart showing operations of the resonance control circuit 102. The resonance control circuit 102 generates a PFM signal that is an output signal of a square wave by comparing a serrate pulse Vsaw generated by the one-shot pulse generator 102*a* with the reference voltage Vref by using the comparator 102*b*. The duty of the PFM signal can be changed by changing the reference voltage Vref at Point1 and Point2 shown in FIG. 3.

As shown in FIG. 3, when the reference voltage Vref is lowered, the high level (High) time of the PFM signal that is an output signal becomes longer, increasing the time to flow a current to the induction-heating coil L1, which also increases the temperature of the fixing roller 32 and the power consumption.

Figure 4:
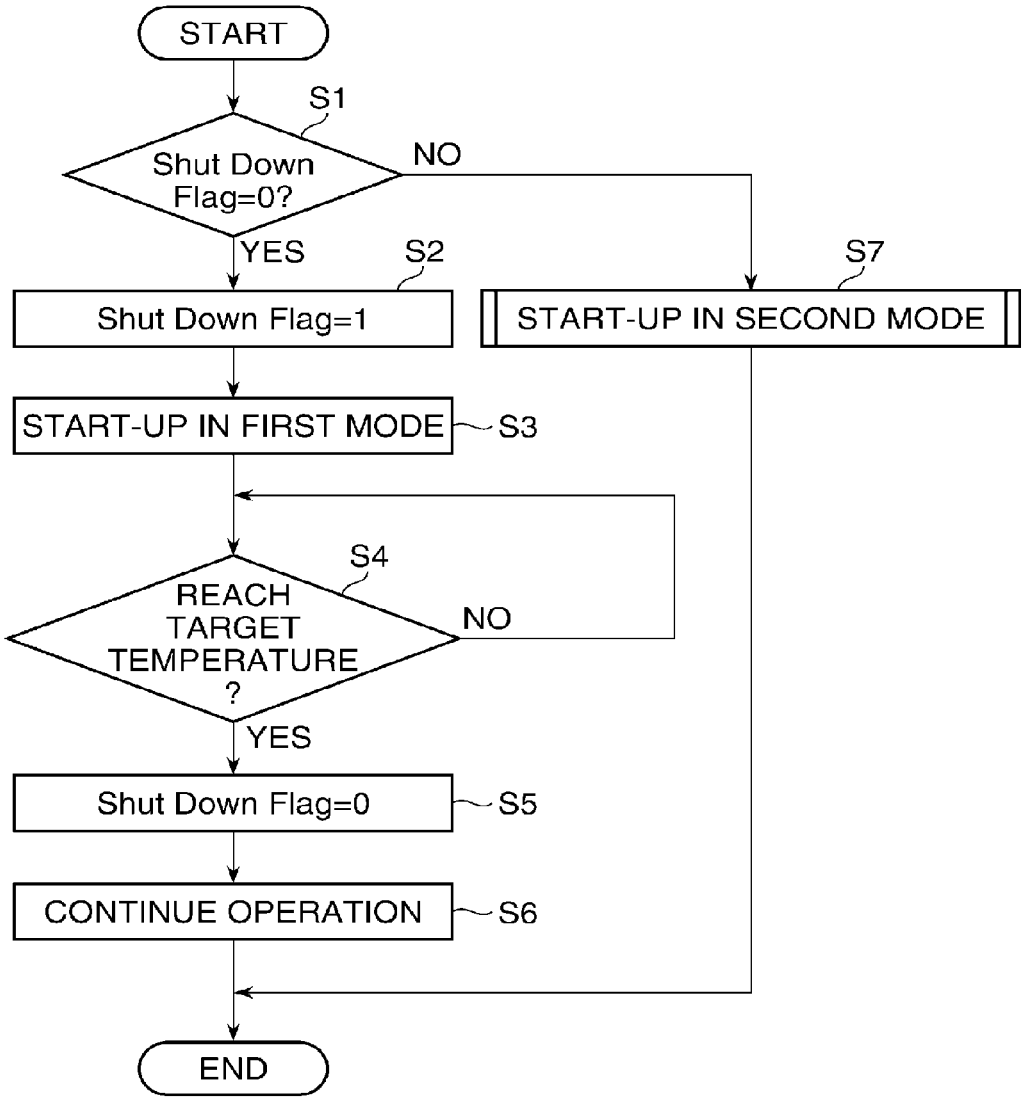
FIG. 4 is a flowchart showing operation procedures at a time of a start-up of the image forming apparatus shown in FIG. 1.

FIG. 4 is a flowchart showing operation procedures at a time of a start-up of the image forming apparatus. A processing program for these operation procedures is stored in the ROM 111, and executed by the CPU 105 when a user pushes a switch (a main switch 14*a* of the operation unit 14) on the image forming apparatus and then the apparatus starts.

First, the CPU 105 determines how the image forming apparatus started at the last start-up by determining whether a value of a shutdown flag stored in the RAM 112 is zero or not (step S1). The value of the shutdown flag becomes data showing whether the image forming apparatus started successfully. The value "0" of the shutdown flag means that the apparatus started successfully at the last start-up. The value "1" of the shutdown flag means that the apparatus did not start successfully at the last start-up.

When the value of the shutdown flag at the end of the last start-up stored in the RAM 112 is "1", it means that the image forming apparatus did not start successfully, and the CPU 105 (acting as a mode selection unit) starts the image forming apparatus in a second mode that is a start-up sequence under an abnormal condition (step S7). In the second mode, in order to prevent the shutdown by a voltage drop, the electric power that is lower than regular electric power is applied to the fixing unit at the beginning of a start-up. And then, the applied electric power increases up to the regular electric power. The process in the step S7 will be described later. Then, the CPU 105 finishes the process of the start-up.

On the other hand, when the value of the shutdown flag is determined to be "0" in step S1, the CPU 105 rewrites the value of the shutdown flag to "1" (step S2). And the CPU 105 (acting as a mode selection unit) starts the image forming apparatus in a first mode that is a normal start-up sequence (step S3). In the first mode, in order to shorten a warm-up time, the regular electric power is supplied to the fixing unit from the beginning of the start-up. Namely, the time period required to reach the regular electric power from starting to supply the electric power in the second mode is longer than that in the first mode.

And the CPU 105 waits until the temperature of the fixing unit reaches the target temperature (step S4). When the temperature of the fixing unit reaches the target temperature and the start-up of the image forming apparatus is completed in the first mode, the CPU 105 sets the value of the shutdown flag to "0" (step S5), and continues the operation of the image forming apparatus (step S6). That is, the value of the shutdown flag is changed to the data showing that the image forming apparatus started up successfully. Then, the CPU 105 finishes the process of the start-up.

At the time of the start-up in the first mode in step S3, since large electric power is supplied to the fixing unit instantaneously, the image forming apparatus may suddenly shut down at a location where the power source condition is poor etc. In such a case, the value of the shutdown flag stored in the RAM 112 still remains as "1". Therefore, in the next start-up, it will be determined to start up in the second mode in step S1, and the image forming apparatus will start in the second mode in step S7.

Figure 5:
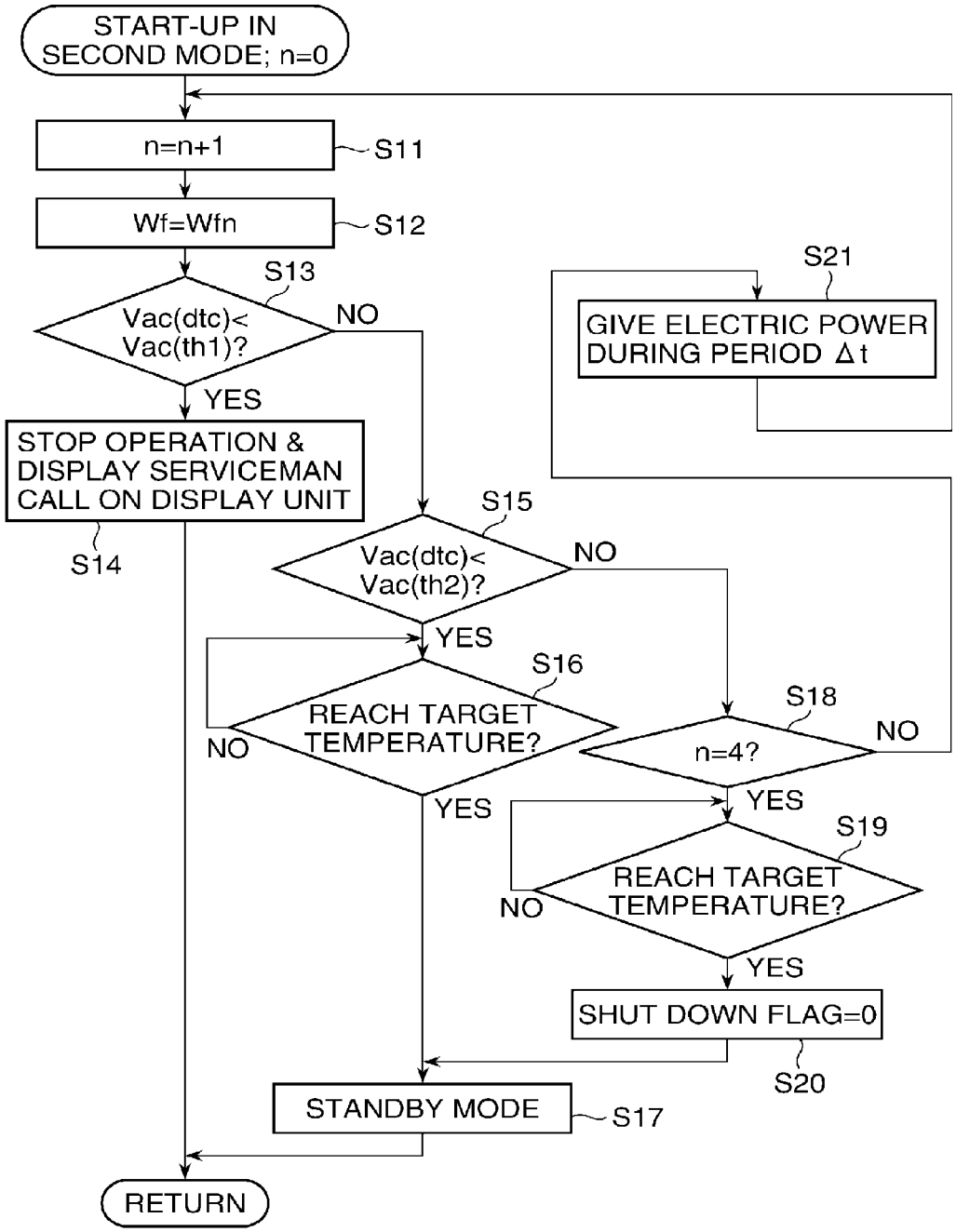
FIG. 5 is a flowchart showing start-up operation procedures in a second mode shown in step S7 of FIG. 4.

FIG. 5 is a flowchart showing start-up operation procedures in the second mode shown in step S7 of FIG. 4. When the image forming apparatus starts up in the second mode, the CPU 105 (acting as a power control unit) raises a power step n by "1" (step S11). It should be noted that an initial value of the power step n is "0".

First, the CPU 105 raises electric power Wf that is supplied to the fixing unit (referred to as "fixing electric power", hereinafter) to a power value Wfn that is the target power corresponding to the n-th step (step S12).

The CPU 105 determines whether the AC detection voltage Vac (dtc) at this time is less than a low threshold value Vac (th1) that is a guaranteed operation voltage of the image forming apparatus (step S13). When the AC detection voltage Vac (dtc) is less than the low threshold value Vac (th1), the CPU 105 stops the operation of the image forming apparatus and displays a warning showing that a serviceman call is needed on the display unit 14*b* (step S14). Then, the CPU 105 returns to the original process.

On the other hand, when the AC detection voltage Vac (dtc) is not less than the low threshold value Vac (th1), the CPU 105 determines whether the AC detection voltage Vac (dtc) is less than a predetermined threshold value Vac (th2) (step S15). The predetermined threshold value Vac (th2) is a threshold of a power source voltage used in order to determine the fixing electric power when starting up in the second mode.

When the AC detection voltage Vac (dtc) is less than the predetermined threshold value Vac (th2), the CPU 105 starts the image forming apparatus with the fixing electric power (the target power) determined in step S12, and determines whether the fixing unit reaches the target temperature (step S16). In order to determine whether the temperature of the fixing unit reaches the target temperature, the CPU 105 compares the output of the above-mentioned thermistor 68 with the target temperature. When the difference therebetween falls within a predetermined range, the CPU 105 determines that the temperature of the fixing unit reaches the target temperature.

The CPU 105 repeats the process in step S16 to continue giving the target electric power to the fixing unit (supplies the electric power) until the fixing unit reaches the target temperature. And when reaching the target temperature, the CPU 105 shifts the mode to a standby mode for waiting until a print start instruction is issued, and continues the operation of the image forming apparatus (step S17). Then, the CPU 105 returns to the original process.

On the other hand, when it is determined that the AC detection voltage Vac (dtc) is not less than the predetermined threshold value Vac (th2) in S15, the CPU 105 determines whether the current power step n is "4" corresponding to the power value Wf4 that enables the start-up in the first mode (step S18).

When the current power step n is "4", the CPU 105 determines whether the fixing unit reached the target temperature (step S19). The CPU 105 repeats the process in step S19 to continue giving the target electric power to the fixing unit until the fixing unit reaches the target temperature. When reaching the target temperature, the CPU 105 writes the value "0" to the shutdown flag stored in the RAM 112 in order to start in the first mode at the next start-up (step S20). Then, the CPU 105 shifts the mode to the standby mode for waiting until a print start instruction is issued in step S17.

On the other hand, when it is determined that the current power step n is not "4" in step S18, the CPU 105 gives electric power to the fixing unit during a predetermined period Δt (step S21). And the CPU 105 returns to the process in step S11, raises the power step by "1", and shifts to a target power of the next step.

Figure 6:
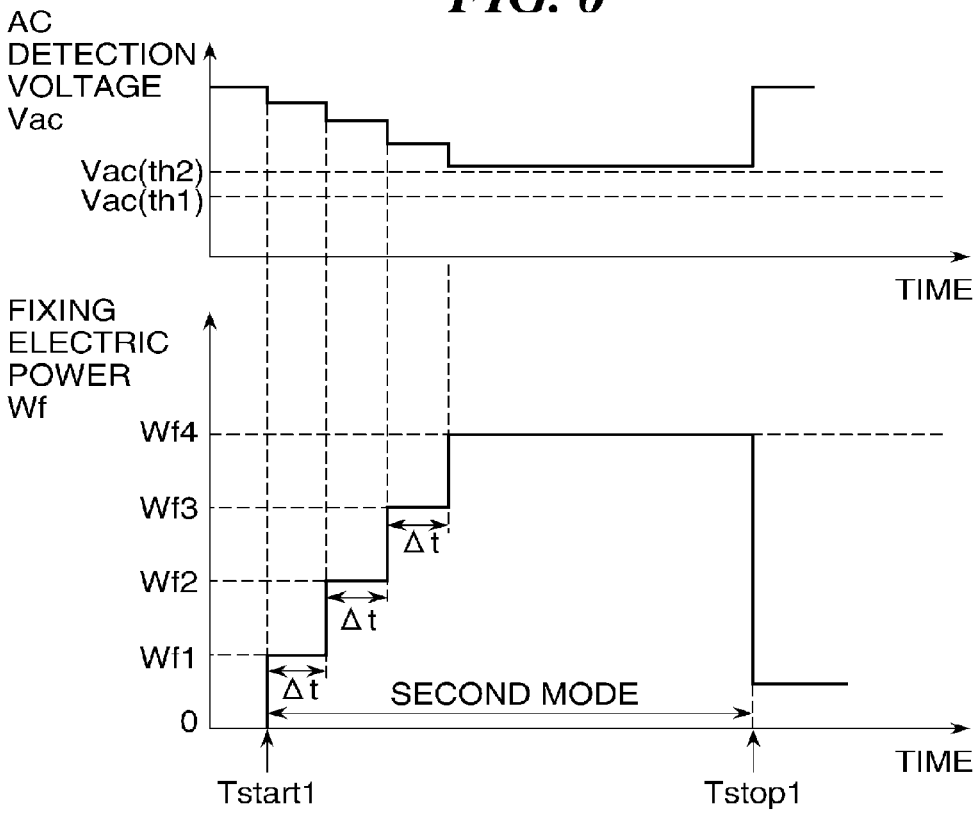
FIG. 6 is a timing chart that shows an example of a relationship between electric power supplied to the fixing unit and voltage detected by an AC voltage detection circuit when the image forming apparatus shown in FIG. 1 is started in the second mode.
Figure 7:
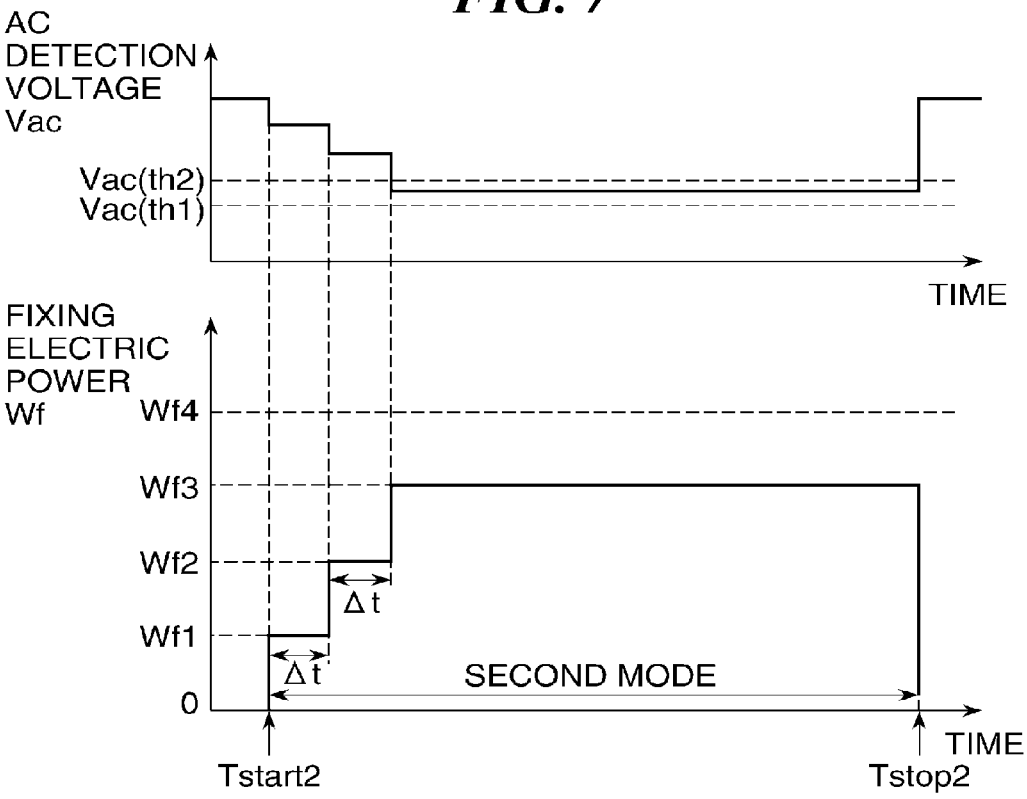
FIG. 7 is a timing chart that shows another example of a relationship between electric power supplied to the fixing unit and voltage detected by the AC voltage detection circuit when the image forming apparatus shown in FIG. 1 is started in the second mode.
Figure 8:
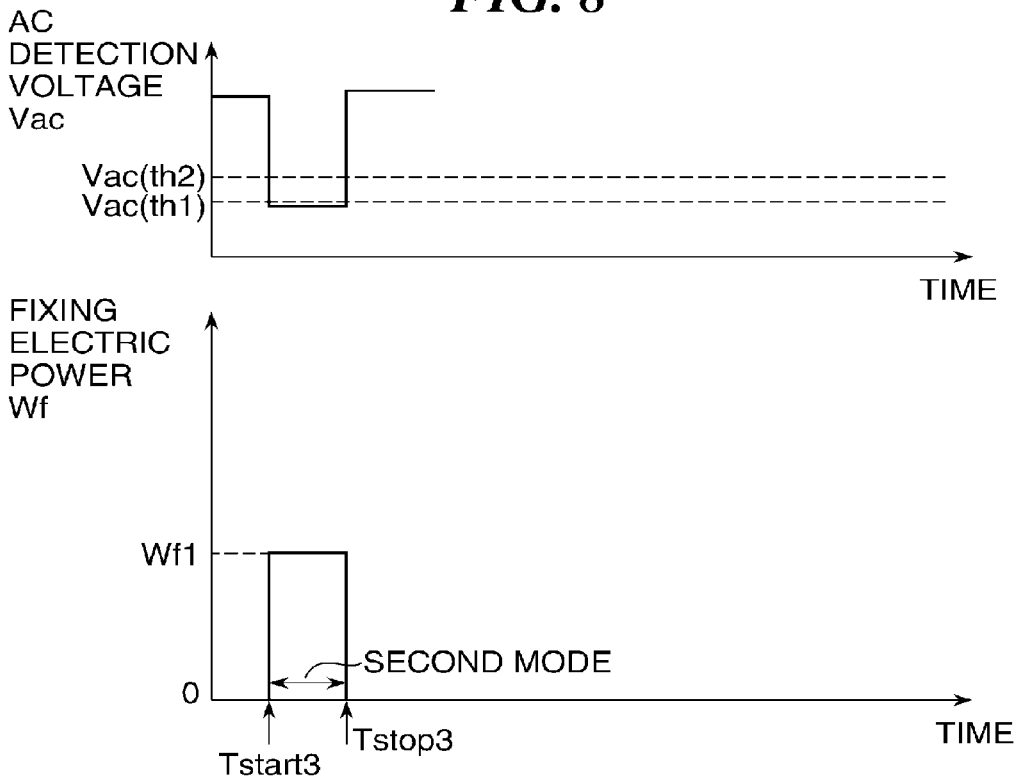
FIG. 8 is a timing chart that shows still-another example of a relationship between electric power supplied to the fixing unit and voltage detected by the AC voltage detection circuit when the image forming apparatus shown in FIG. 1 is started in the second mode.

FIG. 6, FIG. 7, and FIG. 8 are timing charts that show examples of a relationship between the fixing electric power Wf and the detection voltage Vac (dtc) detected by the AC voltage detection circuit 107 when the image forming apparatus is started in the second mode. That is, when the apparatus has shut down for a certain reason at the time of the start-up in the first mode, at the next start-up, the apparatus starts up in the second mode in which an increasing rate of the fixing electric power is mild. The charts show the relationships between the fixing electric power Wf and the detection voltage Vac (dtc) when the apparatus starts in the second mode.

In the second mode, the fixing electric power Wf increases in stages using the power values Wf1 through Wf4. Here, it is assumed that the power value Wf1 is the minimum operating power of the image forming apparatus and the power value Wf4 is the fixing electric power supplied at the time of the start-up in the first mode. Although the present embodiment shows the case where the fixing electric power increases in stages in the second mode, it may vary continuously. Although the present embodiment changes the fixing electric value Wf in four steps to the power value Wf4, the number of steps is not limited to four steps, it may be changed in any steps.

The predetermined threshold value Vac (th2) of the power source voltage is set to be higher than the low threshold value Vac (th1) in which the operation guarantee of the image forming apparatus becomes impossible due to a source voltage drop.

In FIG. 6, at the start-up in the second mode, the fixing electric power Wf increases in stages up to the power value Wf4 every time the predetermined period Δt elapses (time from Tstart1 to Tstop1). And since the AC detection voltage Vac satisfies a formula (1), the image forming apparatus operates with the power value Wf4.

$$Vac(dtc)>Vac(th2) \quad (1)$$

In this case, setting the value "0" in the shutdown flag stored in the RAM 112 after the completion of the start-up with the power value Wf4, the apparatus can be started in the first mode at the next start-up. Therefore, when the source voltage drops temporarily, the start-up in the second mode does not repeat many times.

In FIG. 7, at the start-up in the second mode, the fixing electric power Wf increases in stages up to the power value Wf3 (time from Tstart2 to Tstop2). And the AC detection voltage Vac satisfies the formula (2).

$$Vac(th1)<Vac(dtc)<Vac(th2) \quad (2)$$

In this case, it is impossible to start the image forming apparatus in the first mode. However, since it is possible to start the image forming apparatus with the power value Wf3, the start-up time is extended as compared with the first mode (Tstop2>Tstop1), which enables to start up the image forming apparatus.

In FIG. 8, when the fixing electric power Wf increases to the power value Wf1 in the second mode (time from Tstart3 to Tstop3), the AC detection voltage Vac comes to satisfy a formula (3)

$$Vac(dtc)<Vac(th1) \quad (3)$$

In this case, when the image forming apparatus starts with the power value Wf1 that is the minimum operating power required for starting the apparatus, the AC detection voltage Vac (dtc) becomes less than the low threshold value Vac (th1) in which the operation guarantee of the image forming apparatus is impossible. In this case, since the minimum operating power for the image forming apparatus cannot be obtained at the time of the start-up, the image forming apparatus stops the operation, prohibits a start-up on and after the next time, and displays a serviceman call on the display unit 14*b*.

As described above, according to the present embodiment, when the image forming apparatus has shut down for a certain reason at the time of the start-up in the normal first mode, at the next start-up, the apparatus starts up in the second mode in which an increasing rate of the electric power is mild. Accordingly, the causes of the shutdown can be divided.

The causes can be divided into the following cases: (A) the power source capacity is enough, and the apparatus can start up in the normal first mode; (B) the power source capacity is small, but the electric power can be supplied so that the apparatus can operate; and (C) the power source capacity is small, and the electric power stops because the operation of the apparatus cannot be guaranteed. This division enables to operate the apparatus with grasping the operating environment of the apparatus.

Therefore, the image forming apparatus can operate with reliability and the down time can be shortened. At the same time, it becomes easy to search a cause at the time of a halt. In the above case (C), since a message describing the content of the case (C) is displayed, a user can easily know that the image forming apparatus cannot be started, and a user can notify a serviceman promptly. The message urges a user to check the circumstance of branch and the power source voltage, and make it possible for a user to change the power source arrangement into a suitable arrangement. Accordingly, a possibility of a halt at the next start-up can be reduced. It should be noted that a message describing the content of the case (B) can be displayed to inform a user of the operation condition in the above case (B).

According to the embodiment, the electric power supplied to the induction-heating coil L1 of the fixing roller 32 that needs much power can be controlled. The electric power supplied to the induction-heating coil L1 of the fixing roller 32 can be reduced according to the voltage drop of the alternating current (AC) voltage from the commercial power. Therefore, the image forming apparatus can be started without resulting in a halt even in the installed location where the power source condition is poor.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

For example, although the above-mentioned embodiment shows the case where the load is the fixing unit, the present invention is not limited to this. That is, the load may be another unit that needs large electric power in the image forming apparatus, or various attachment devices that are connected to the image forming apparatus and whose powers are supplied by the image forming apparatus.

Further, the present invention can be applied to not only a system that consists of a plurality of devices, but also an apparatus that consists of one device. The image forming apparatus may be a multifunctional printer (MFP) that has a printing function, a copying function, and a scanning function, etc.; a facsimile machine that has a printing function; or a single functional printer.

Although the above-mentioned embodiment shows the case where the printing method of the image forming apparatus is an electro photography method, the present invention is not limited to the electro photography method. That is, the present invention can be applied to various methods, such as an inkjet method, a thermal transfer method, a thermal method, an electrostatic method, and a discharge-breakdown method.

Further, the sheet is not limited, and a paper medium, an OHP sheet, a thick paper, etc. can be used.

This application claims priority from Japanese Patent Application No. 2008-214100, filed on Aug. 22, 2008, which is hereby incorporated by reference herein in its entirety.

What is claimed is:

1. An image forming apparatus comprising:

an image forming unit adapted to form a toner image on a sheet;

a fixing unit adapted to thermally fix, on the sheet, the toner image formed on the sheet by said image forming unit;

a temperature detection unit adapted to detect temperature of said fixing unit;

an electric power supplying unit adapted to supply electric power to said fixing unit;

a setting unit adapted to set a first value to a memory when the temperature detected by said temperature detection unit reaches a target temperature, in a case where said electric power supplying unit supplies a first electric power to said fixing unit; and a mode selection unit adapted to select a first mode in which said electric power supplying unit supplies the first electric power to said fixing unit, in a case where the first value is set to the memory when the image forming apparatus is powered on, and select a second mode in which said electric power supplying unit supplies a second electric power less than the first electric power to said fixing unit, in a case where a second value different from the first value is set to the memory when the image forming apparatus is powered on, wherein said electric power supplying unit controls the electric power supplied to said fixing unit according to whether the first mode or the second mode is selected by said mode selection unit, and wherein said setting unit changes the first value of the memory to the second value, in a case where the first value is set to the memory when the image forming apparatus is powered on.

2. The image forming apparatus according to claim 1, wherein said electric power supplying unit increases the electric power supplied to said fixing unit after having supplied the second electric power to said fixing unit, in a case where the second mode is selected by said mode selection unit.

3. The image forming apparatus according to claim 2, wherein said electric power supplying unit gradually increases the electric power, that is supplied to said fixing unit, from the second electric power to the first electric power.

4. The image forming apparatus according to claim 3, further comprising a voltage value detection unit adapted to detect a voltage value that is supplied to said electric power supplying unit, wherein said electric power supplying unit stops increasing the electric power supplied to said fixing unit when the voltage value detected by said voltage value detection unit is less than a first threshold value before the electric power supplied to said fixing unit reaches the first electric power, in a case where the second mode is selected by said mode selection unit.

5. The image forming apparatus according to claim 4, wherein said electric power supplying unit stops supplying the electric power to said fixing unit when the voltage value detected by said voltage value detection unit is less than a second threshold value that is lower than the first threshold value.

6. The image forming apparatus according to claim 5, further comprising a display unit adapted to display that the image forming apparatus is in an abnormal condition, in a case where said electric power supply unit stops supplying the electric power to said fixing unit.

7. The image forming apparatus according to claim 2, further comprising a voltage value detection unit adapted to detect a voltage value that is supplied to the electric power supplying unit, wherein said electric power supplying unit increases the electric power that is supplied to said fixing unit, in a case where the voltage value detected by said voltage value detection unit is greater than a predetermined threshold value.

8. The image forming apparatus according to claim 7, wherein the electric power supplying unit stops supplying the electric power to said fixing unit when the voltage value detected by said voltage value detection unit is less than the predetermined threshold value.

9. An electric power control method of an image forming apparatus provided with an image forming unit adapted to form a toner image on a sheet; a fixing unit adapted to thermally fix, on the sheet, the toner image formed on the sheet by said image forming unit; and a temperature detection unit adapted to detect temperature of said fixing unit, the electric power control method comprising:

an electric power supplying step of supplying electric power to said fixing unit;

a setting step of setting a first value to a memory when the temperature detected at said temperature detection step reaches a target temperature, in a case where a first electric power is supplied to said fixing unit at said electric power supplying step; and a mode selection step of selecting a first mode in which the first electric power is supplied to said fixing unit at said electric power supplying step, in a case where the first value is set to the memory when the image forming apparatus is powered on, and selecting a second mode in which a second electric power less than the first electric power is supplied to said fixing unit at said electric power supplying step, in a case where a second value different from the first value is set to the memory when the image forming apparatus is powered on, wherein said electric power supplying step comprises controlling the electric power supplied to said fixing unit according to whether the first mode or the second mode is selected at said mode selection step, and wherein said setting step changes the first value of the memory to the second value, in a case where the first value is set to the memory when the image forming apparatus is powered on.

* * * * *